United States Patent [19]

Timson

[11] 4,025,065

[45] May 24, 1977

[54] METHOD OF AND MACHINERY FOR PRODUCING BOOK BLOCKS

[75] Inventor: Ernest Arthur Timson, Kettering, England

[73] Assignee: Timsons Limited, Kettering, England

[22] Filed: May 27, 1975

[21] Appl. No.: 581,030

[30] Foreign Application Priority Data

May 31, 1974 United Kingdom ..... 24355/74

[52] U.S. Cl. ..... 270/12; 270/58

[51] Int. Cl.[2] ..... B41F 13/64

[58] Field of Search ..... 270/1–22, 270/37–38, 42–45, 47–48, 51–52, 54–58

[56] References Cited

UNITED STATES PATENTS

| | | | |
|---|---|---|---|
| 2,631,845 | 3/1953 | Zuckerman | 270/5 |
| 2,873,113 | 2/1959 | McWhorter | 270/55 |
| 3,977,665 | 8/1976 | Bowman | 270/4 |

*Primary Examiner*—Edgar S. Burr
*Assistant Examiner*—A. Heinz
*Attorney, Agent, or Firm*—Hibben, Noyes & Bicknell, Ltd.

[57] ABSTRACT

A method and apparatus for assembling a block for a double book or double book section in a 2-up coming and going method of bookmaking by providing a stream of groups of book elements each containing all the primary pages of the book or book section. The groups of the stream are conveyed along a rectilinear path towards a rotary turn-over member and alternate groups of the stream, which form a first series, are diverted from the path to pass around the turn-over member so as to be turned through 180° about as axis parallel to the junction between the two pages on each leaf of group while the remaining groups, which form a second series are caused to continue along said path. The groups of the first and second series approach a combining station from opposite directions and are combined in pairs at the station. If the elements of the groups are uncollated, the elements are collated into half-block form before they reach the combining station and are then brought together in pairs at the combining station to form blocks, each block comprising a half-block of the first series and a half-block of the second series.

2 Claims, 3 Drawing Figures

METHOD OF AND MACHINERY FOR PRODUCING BOOK BLOCKS

BACKGROUND OF THE INVENTION

Field of the Invention

This invention relates to 2-up coming and going methods of bookmaking. The term "book" a used herein in a broad sense to mean any assembly of pages arranged in a required order and includes not only printed books in the normal sense but, for example, diaries and any collection of printed sheets arranged in a required order.

Bookmaking using the 2-up coming and going method involves making two books or book sections at once from a paper web which has been printed so that each successive length of the web shows a numbr of pages each of which appears only once, the pages being printed in such positions that after slitting, cutting, if necessary folding, and collating a half block is formed which has two side-by-side sequences of pages. This half-block contains all the pages, hereinafter referred to as the primary pages, of the book or book section which have been printed on the web. Each side of each leaf of the half-block shows two pages arranged head-to-head or tail-to-tail, one page being from one sequence and the other page being from the other sequence. Each sequence contains half the primary pages of the book or section, one sequence containing the primary pages of the first half of the book or section in proper order and the other sequence containing the primary pages of the second half of the book or section in proper order. If one considers the order of the primary pages in each sequence with respect to one face of the half-block then the primary pages in one sequence "go" from that face while the primary pages in the other sequence "come" to that face.

In addition to the primary pages the half-block may also include secondary or inserted pages such as drawings, photographs or title pages which are not printed in the same operation as the printing of the web referred to above. These inserted pages may, for example, be fed into the half-block during collating. Alternatively, the inserted pages may be grouped together in a separately printed insert section which may be fed between two half-blocks when the half-blocks are combined to form a block as described below, may be added to one of the half-blocks before the half-blocks are combined, or may be fed onto the top or bottom of the block after the half-blocks have been combined.

A book consisting of, for example, 192 primary pages, may be made by arranging one face of each half-block to show pages 1 and 192 while the leaf at the opposite face of each half-block will show pages 96 to 97. Pages 1 to 96 will in each half-block go from the one face to the other and pages 97 to 192 of that half-block will come to that face from the other face.

A block is then made by the imposition of one half-block on another identical half-block which is reversed in position relative to the one half-block so that the block thus formed can be separated into two books each of which will have all the required primary pages.

Thus in the example given above, the faces of the two halfblocks which show pages 96 and 97 would be juxtaposed with page 96 of each half-block opposite page 97 of the other half-block.

As previously indicated, two book sections can also be made at once using the 2-up coming and going method described above. In this instance a block will be formed which can be separated into two book sections each of which will have all the required pages.

The above block can be combined, prior to separation, with other sections of the book printed using the 2-up coming and going method to produce a larger block which can be separated into two complete books.

The half-blocks referred to above will be made up from sheets or signatures, hereinafter referred to as "book elements".

SUMMARY OF THE INVENTION

The invention is concerned with a continuous method of, and apparatus for, assembling in the correct relative position two halves of a block for a double book or double book section in the 2-up coming and going method of bookmaking.

According to one aspect of the invention we provide a method of assembling a block for a double book or double book section in a 2-up coming and going method of bookmaking in which successive lengths of a paper web have each been identically printed so that each length shows in total a number of primary book pages each of which appears once only, the method of assembly comprising providing a stream of identical groups of both elements, each group consisting of leaves formed by cutting and slitting one of said lengths and containing all of said primary pages arranged in pairs on the leaves head to head or tail to tail with each pair of pages meeting in a junction; conveying all the groups in the stream along a rectilinear path towards a combining station; diverting alternate groups of the stream, and which form a first series, from said path; turning the groups of the first series through 180° about an axis parallel to the junction between said two pages printed on said leaves; causing the remaining groups, which form a second series, to continue along said path; collating the elements of each group into a half-block before the group reaches the combining station; and then bringing together in pairs half-blocks of the first series and halfblocks of the second series by bringing each half-block of the first series to said combining station along a second rectilinear path parallel to and adjacent to said first-mentioned rectilinear path thus to form blocks each comprising a half-block of the first series and a half-block of the second series, each half block of the first series arriving at said combining station in an orientation in which it has been turned through 180° about an axis parallel to said junction between said two pages printed on the leaves of the half-block of the first series relative to the orientation of each half-block of said second series arriving at said combining station and the half-blocks of the two series arrivin at the combining station from opposite directions.

According to another aspect of the invention we provide apparatus for assembling a block for a double book or double book section in a 2-up coming and going method of book making in which successive lengths of a paper web have each been identically printed so that each length shows in total a number of primary book pages each of which appears once only, the apparatus comprising a supply means arranged to supply groups of book elements, each group consisting of leaves formed by cutting and slitting one of said lengths and containing all of said primary pages arranged in pairs on the leaves head to head or tail to tail, with each pair of pages meeting in a junction; means for feeding said groups in a stream along a rectilinear path towards a combining station; a rotary member arranged to turn over a succession of said groups through 180° about an axis parallel to the junction between said two pages printed on the leaves of the group; means for diverting alternate groups of the stream from said path, said groups forming a first series and being turned by said rotary member; means for conveying the remaining group of the stream and which form a second series from the diverter means along the path to the combining station; means for collating the elements of each group into a half-block before the groups reach the combining station; means for bringing together in pairs to form blocks half-blocks of the first series and half-blocks of the second series by bringing each half-block of the first series to the combining station along a second rectilinear path between the rotary member and the combining station and parallel to said first mentioned rectilinear path whereby each block comprises one half-block from the first series and one half-block from the second series, each half-block of the first series arriving at said combining station in an orientation in which it has been turned through 180° about an axis parallel to said junction between said two pages printed on the leaves of the half-block of the first series relative to the orientation of each half-block of said second series arriving at said combining station.

In either aspect, the path may be horizontal and the rotary member may rotate about a vertical axis while the half-blocks or groups of the first series pass around the member while on edge.

If desired, the half-blocks can be gummed as they move along and before the stream is divided into the first and second series.

BRIEF DESCRIPTION OF THE DRAWINGS

The invention will now be described in detail by way of example with reference to the accompanying diagrammatic drawings in which:-

DESCRIPTION OF A PREFERRED EMBODIMENT

The principles of 2-up coming and going book making will first be explained briefly with reference to FIGS. 1 and 2 and with reference to the manufacture of a book consisting of 192 primary pages.

Figure 1:
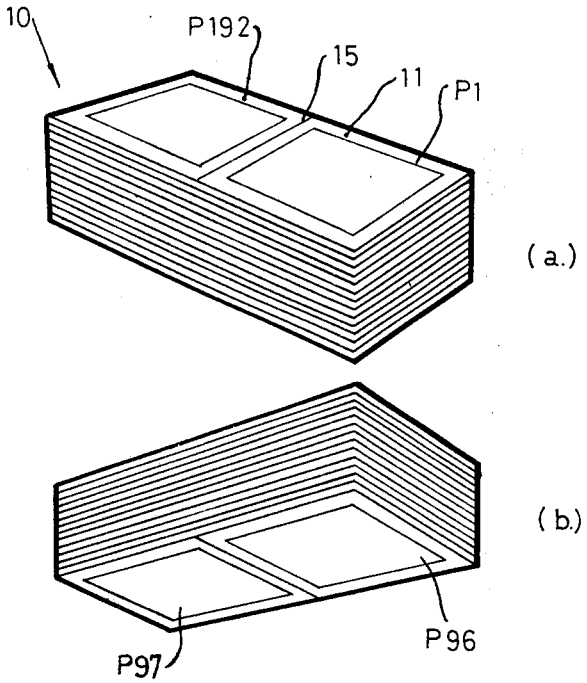
FIG. 1(*a*) and 1(*b*) show a half-block for a double book and show the upper and lower faces thereof respectively.

Referring first to FIG. 1, this shows a half-block for a double book indicated generally at 10. Each leaf of the half-block shows, on each side, two pages which are arranged either head-to- head or tail-to-tail. For example, the upper side of the upper leaf 11 of the half block shown in FIG. 1(*a*) shows page 1 and page 192 designated P1 and P192 respectively. As can be seen from FIG. 1(*b*) the downwardly facing side of the bottom leaf of the half block 10 shows pages 96 and 97 designated P96 and P97 respectively, There are two page sequences through the half-block, thus there is the right-hand page sequence which goes from page 1 to page 96 and there is the left-hand sequence of pages which comes from pages 97 to 192. The "going" and "coming" is with reference to the face of the half-block at which the leaf 11 is situated. It will be appreciated that each leaf is printed on each side thereof and that the upper leaf 11, for example, has on the righthand half of its other side the page 2 and on the lefthand half of the other side the page 191.

Figure 2:
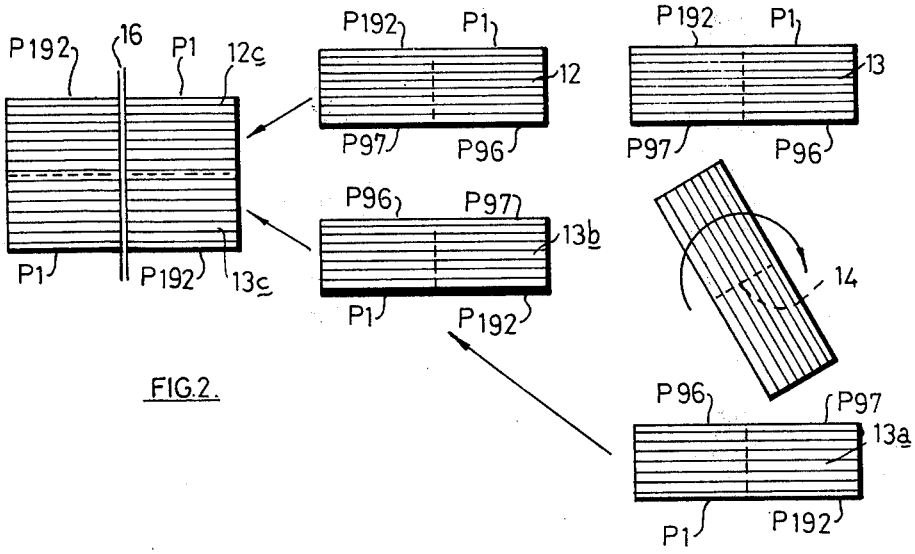
FIG. 2 is a diagram illustrating how two identical half-blocks can be placed together to form a block from which two books can be made.

FIG. 2 shows two half-blocks indentical to that shown in FIG. 1, the half-blocks being indicated at 12 and 13 and the numbers of the pages shown at opposite faces of the half-blocks being indicated. The two half-blocks are shown side by side at the top of the figure in the same orientation. The half-block 13 is now turned through 180° about an axis 14 which is parallel to the junction 15, shown in FIg. 1 between the two pages shown on each leaf of the half-block. The half-block 13 is shown after having completed its turn at 13*a*. It will be seen that pages 96 and 97 are now shown at the upper face of the half-block and are reversed, left to right, with respect to their positions with the half-block in the position 13. Thus at 13*a* page 96 is to the left and page 97 is to the right whereas when the half-block is in the position shown at 13 page 97 is to the left and page 96 to the right. The half-block 13 can now be moved to a position such as shown at 13*b* in which it lies under the half-block 12 and it will be seen that the page 96 of the half-block 13 lies under page 97 of the half-block 12 while page 97 of the half-block 13 lies under page 96 of the half-block 12. Thus when the two half-blocks are placed together as shown at 12*c* and 13*c* one has a block for a double book. On the right hand side the pages go downwardly from 1 to 192 while on the left hand side the pages come upwardly from page 1 to page 192. The block can now be cut as indicated at 16 to form two books. Normally the block will be bound before being cut into the separate books.

It will be seen from the foregoing diagrammatic explanation that it is necessary to turn one of the half-blocks forming the block through 180° with respect to the other half-block and then to superimpose the two half-blocks so as to get the whole series of pages coming at one side of the block and going at the other. The invention is concerned with a method of and apparatus for turning and putting together the half-blocks.

Figure 3:
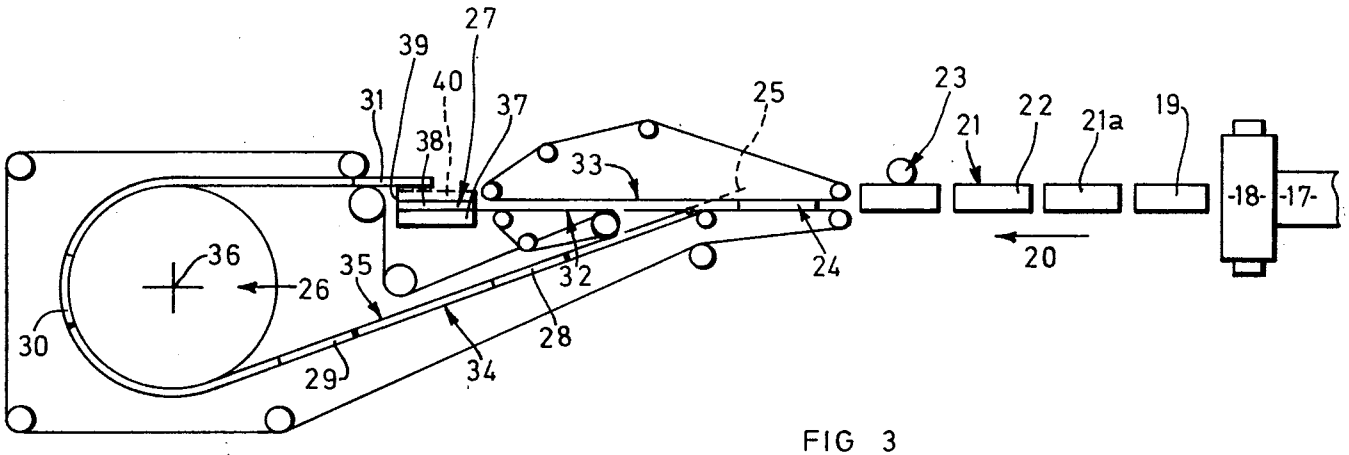
FIG. 3 is a diagram illustrating in plan an apparatus embodying the invention for assembling bookblocks in the 2-up coming and going method of bookmaking.

Referring now to FIG. 3, a pre-printed web is indicated at 17 and passes through a cutting unit 18 which may include folding means so that sheets or signatures are delivered as indicated at 19. The web will have been printed in the manner described above for 2-up coming and going bookmaking. The separate sheets or signatures pass along in the direction of the arrow 20 to a collating station 21 wherein successive groups of sheets or signatures are gathered together into half-blocks, one of which is indicated at 22. Prior to reaching the collating station the sheets or signatures may be jogged to align them at 21*a*. The half-block then passes to a gumming station 23 where the spine of the half-block is gummed. The half-block as it passes further to the left, is then turned on edge at a turning station 24. The half-blocks are controlled by a diverter means in the form of selector fingers 25. It will be appreciated that there is a continuous stream of half-blocks passing from the collating station 21 towards the diverter fingers 25. When the half-blocks have been turned on edge, they will be supported by conveying tape systems and the selector fingers 25 are so controlled that they divert alternate half-blocks, which form a first series, around a rotary member indicated generally at 26 and the remaining half-blocks which form a second series are allowed to move to a position indicated at 27 without diversion. It will be noted that the half-blocks of the stream move along a rectilinear path towards the member 26, those of the first series being diverted from the path and those of the second series continuing on the path to the position 27.

Half-blocks of the first series are indicated at 28 to 31 respectively and it will be appreciated that each half-block which starts at position 28 will travel to a position 31 having been around the rotary member 26. The half-blocks are supported by a transport system indicated generally at 34 and 35 and are moved around the rotary member while remaining horizontal, the rotary member rotating about a vertical axis 36. The half-blocks of the second series are fed directly from the turning station 24 to the position 27 initially by the part 34 of the previously referred to tape transport system and then by a further tape transport system indicated generally at 32 and 33. One of the half-blocks of the second series is indicated at 38 having been brought into engagement with an abutment 39 at a combining station by the tape transport system 32 and 33. One of the half-blocks of the first series is indicated at 40 and it will be seen that this overlies the half-block 38 and has been delivered onto the upper surface of the half-block at the combining station from between the tape transport systems 34 and 35. The two half-blocks 38 and 40 will therefore form a block for a double book since the half-block 40 will have been turned through 180° about the axis 36 which will be parallel to the junction between the pages on each leaf thereof so that the pages in the block will run correctly. By the time the half-block 31 is delivered from between the tape transport systems 34 and 35 a further half-block of the second series will have been fed by the tape transport system 37 into the position occupied by the half-block 38. Conveyor means 37 will now remove the completed block to a delivery station, the conveying means moving the block in a direction transverse to the plane of the drawing.

It will be seen that the half-blocks of the first series delivered from the rotary member 26 towards the position occupied by the half-block 31 travel along a second rectilinear path which is parallel to the path followed by the stream through the stations 21, 23 and 24. Moreover, the half-blocks of the second series travel along an extension of the path followed by the stream as a whole as the second series half-blocks move from the fingers 25 to the abutment 39. The half-blocks of the first and second series move to the combining station in opposite directions.

The invention has been described in relation to half-block passing around the rotary member after the half-blocks have been collated at the collating station 21. It would, however, be within the invention to pass groups of sheets or signatures destined to form half-blocks around the rotary member 26 and then collate these groups of sheets into half-blocks as they pass along the second rectilinear path and before arriving at the position occupied by the half-block 31. Similarly, the half-blocks of the second series, i.e. those which do not pass around the rotary member 26, could be collated after the stream had been separated into the two series of groups. Obviously in such an arrangement, the gumming station 23 would be omitted and the collating station would be replaced by two collating stations after the selector fingers 25, one collating station for the groups of sheets or signatures of the first series and the second one for the groups of sheets or signatures of the second series.

Preferably the apparatus described would be placed at the output end of a printing machine so that the web 17 would pass directly from the printing machine to the apparatus described. However, it is within the invention for the web 17 to have been preprinted and reeled and then fed to the cutting device 18.

In the foregoing example the apparatus has been set up to produce blocks for double books which include only primary pages. The apparatus may, however, be modified to feed inserted pages into the half-blocks during collating or to add a separately printed insert section as discussed above.

It is also within the invention to remove the cutting unit 18 and the collating station 21 and to feed directly to the diverter fingers 25 a series of half-blocks 22 which have been prepared on a separate printing, slitting, folding and cutting assembly. Because the apparatus of the invention will automatically turnover each alternate half-block all that is necessary is that the half-blocks be fed into the apparatus all having the same orientation.

Also, although the invention has been described above in relation to the assembly of a book, the invention, as has been previously indicated, is also applicable to the assembly of book sections. When used in this way the half blocks 22 will each contain two side-by-side coming and going sequences of pages, one sequence containing half the pages of the book section and the other sequence containing the other half of the pages of the book section.

It will be seen that the invention provides a comparatively simple and effective means for assembling blocks for double books or double book sections.

I claim:

1. Apparatus for assembling a block for a double book or double hook section in a 2-up coming and going method of bookmaking in which successive lengths of a paper web have each been identically printed so that each length shows in total a number of primary book pages each of which appears once only, the apparatus comprising a supply means arranged to supply groups a book elements, each group consisting of leaves formed by cutting and slitting one of said lengths and containing all of said primary pages arranged in pairs on the leaves head to head or tail to tail, with each pair of pages meeting in a junction; a combining station, means for feeding said groups in a stream along a first rectilinear path towards said combining station; a rotary member arranged to turn over a succession of said groups through 180° about an axis parallel to the junction between said two pages printed on the leaves of the group; means for diverting alternate groups of the stream from said first path, said alternate groups forming a first series and being turned by said rotary member; means for conveying the remaining groups of the stream and which form a second series from said diverter means along said first path to said combining station; means between said supply means and said combining station for collating the elements of each group into a half-block before the groups reach said combining station; said combining station including means for bringing together in pairs, to form blocks, half-blocks of said first series and half-blocks of said second series by bringing each half-block of the first series to the combining station along a second rectilinear path between said rotary member and said combining station, said second path being parallel to said first rectilinear path, said first and second paths approaching said combining station from opposite sides thereof, whereby each block comprises one half-block from the first series and one half-block from the second series, each half-block of the first series arriving at said combining station in an orientation in which it has been turned through 180° by said rotary member about an axis parallel to said junction between said two pages printed on the leaves of the half-block of the first series relative to the orientation of each half-block of said second series arriving at said combining station.

2. Apparatus according to claim 1 in which the rotary member rotates about a vertical axis and wherein the groups of the first series pass around the rotary member with the leaves therein on edge.

* * * * *